United States Patent [19]

Hoofe, III

[11] 4,343,126

[45] Aug. 10, 1982

[54] INTERLOCKING PANELS

[76] Inventor: William J. Hoofe, III, 1816 Newport Hills Dr. East, Newport Beach, Calif. 92660

[21] Appl. No.: 206,691

[22] Filed: Nov. 14, 1980

Related U.S. Application Data

[63] Continuation of Ser. No. 16,119, Feb. 26, 1979, abandoned, which is a continuation-in-part of Ser. No. 914,614, Jun. 9, 1978, abandoned, which is a continuation of Ser. No. 725,256, Sep. 9, 1976, abandoned.

[51] Int. Cl.[3] ..... E04D 1/00

[52] U.S. Cl. ..... 52/313; 52/314; 52/521; 52/555

[58] Field of Search ..... 52/313, 314, 523, 525, 52/527, 522, 520, 521, 519, 539, 545, 555

[56] References Cited

U.S. PATENT DOCUMENTS

| | | | |
|---|---|---|---|
| 471,450 | 3/1892 | White | 52/522 |
| 993,281 | 5/1911 | Todd | 52/522 |
| 1,583,969 | 5/1926 | Greenstreet | 52/522 X |
| 1,597,993 | 8/1926 | Meurer | 52/522 X |
| 1,743,206 | 1/1930 | Fulenwider et al. | 52/520 |
| 2,115,172 | 4/1938 | Kirschbraun | 52/555 X |
| 2,156,277 | 5/1939 | Corbin | 52/526 X |
| 3,412,517 | 11/1968 | Ellis et al. | 52/529 X |
| 3,593,479 | 7/1971 | Hinds et al. | 52/313 |
| 3,686,813 | 8/1972 | Breitwiesner et al. | 52/522 |
| 3,703,795 | 11/1972 | Mattes | 52/521 |
| 3,783,570 | 1/1974 | Storch | 52/520 |
| 3,807,113 | 4/1974 | Turner | 52/555 |
| 3,852,934 | 12/1974 | Kirkhuff | 52/555 |
| 3,862,532 | 1/1975 | Markos | 52/521 |
| 3,868,300 | 2/1975 | Wheeler | 52/555 |
| 3,897,667 | 8/1975 | Turek | 52/555 |
| 3,968,610 | 7/1976 | Medow | 52/314 |
| 3,977,141 | 8/1976 | Peters | 52/313 |
| 3,983,675 | 10/1976 | Pearse et al. | 52/522 |
| 4,015,391 | 4/1977 | Epstein et al. | 52/547 |

FOREIGN PATENT DOCUMENTS

| | | | |
|---|---|---|---|
| 246733 | 2/1961 | Australia | 52/522 |
| 486348 | 9/1952 | Canada | 52/593 |
| 2440497 | 8/1974 | Fed. Rep. of Germany | 52/314 |
| 872817 | 7/1961 | United Kingdom | 52/522 |
| 1309040 | 3/1973 | United Kingdom | 52/313 |
| 1402422 | 8/1975 | United Kingdom | 52/519 |

*Primary Examiner*—J. Karl Bell

*Attorney, Agent, or Firm*—Blakely, Sokoloff, Taylor & Zafman

[57] ABSTRACT

Interlocking panels having a decorative pattern thereon and having a system of interlocks for providing a weatherproof covering system for use as roofing, siding and the like. The panels may be of a readily formed material such as a thermoplastic having a decorative pattern thereon complimentary to the pattern on adjacent panels to provide a continuous decorative roofing or siding panel system. The panels have a simple hook-like region adjacent the upper edge thereof, just below the nail line retaining the panel to the roof, to receive and retain the lower edge of the panels of the next higher course in a manner so as to eliminate the otherwise exposed nailheads. Decorative patterns simulating conventional materials such as shake may be impressed into the panels by vacuum forming and/or other manufacturing techniques. Use of a staggered panel side provides for a substantially hidden junction between sidewise adjacent panels to provide a continuous and unbroken pattern. By dropping the regions separating individual simulated shake to the basic roof plane, maximum panel stability and registry onto the roof surface, as well as enhanced visual characteristics, are achieved.

10 Claims, 12 Drawing Figures

28
50
39
38
60
51b
47
53
36
49
49a
26
41
51a
60c
60b
60a
54
8
8
60c
47
54
53
49
60a

Fig. 9
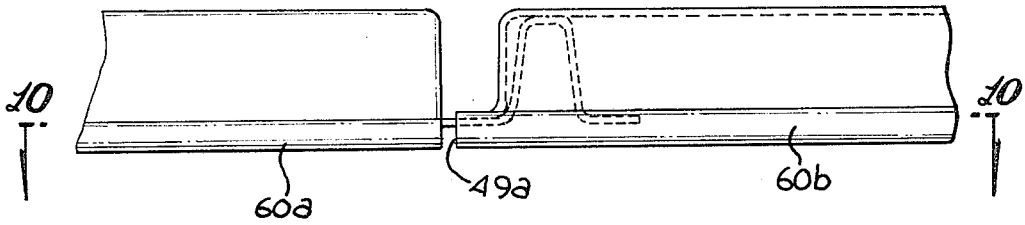
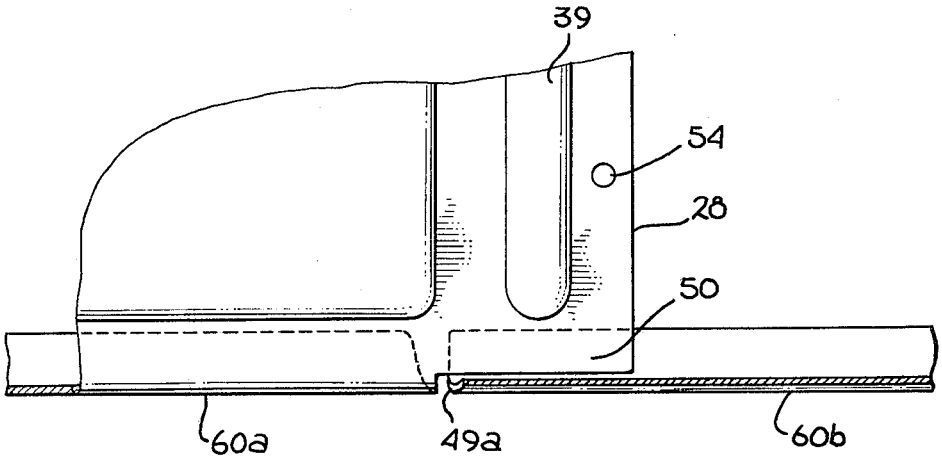
Fig. 10

INTERLOCKING PANELS

CROSS REFERENCE TO RELATED APPLICATIONS

This is a continuation of application Ser. No. 016,119, filed Feb. 26, 1979 now abandoned, which is a continuation-in-part application of application Ser. No. 914,614 entitled "Interlocking Panels", filed June 9, 1978 now abandoned, which application was a continuation of application Ser. No. 725,256 entitled "Interlocking Panels", filed Sept. 9, 1976 and now abandoned.

BACKGROUND OF THE INVENTION

1. Field of the Invention

The present invention relates to construction panels of the type commonly used for decorative facing panels and which may also be used for environmental protection panels, such as roofing and siding panels.

2. Prior Art

A variety of panels for roofing and siding are well known in the prior art, with panels of thermoplastic, metal and fiberglass being commonly used for both purposes. Such panels are often impressed with or molded to have the decorative patterns characteristic of more conventional roofing and siding materials, such as by way of example, shake and tile materials.

One type of prior art panel manufactured by Modular Fixtures Corporation of 638 W. Seventeeth St. Costa, Mesa, Calif. is that shown in U.S. Pat. No. 3,485,002. The panel of that patent specifically simulates a Spanish tile roof, and is particularly suited for fabrication from a thermoplastic, such as ABS, using vacuum forming techniques to provide a decorative low cost panel. Obviously other decorative panels simulating other types of tile, shake or other roofing materials may also be vacuum formed onto thermoplastic sheets to provide substantially limitless ornamental appearances. However, it will be noted that the panels of the foregoing patent are not provided with any interlocking mechanism at the sides thereof, thereby not providing self alignment of adjacent panels, or any means for interlocking the panels to provide coverage of the nail heads to avoid exposed nails. Further, the absence of a suitable interlocking mechanism also inhibits the sealing against moisture between adjacent panels without the use of a suitable sealing compound. Because of the nature of the panels, the line between adjacent panels may be noticeable, and even in the embodiment where overlap of the lower course by the upper course is provided, a sufficient water barrier does not result to prevent leakage during driving rain. Accordingly such panels, regardless of the particular decorative pattern formed therein, have generally been used only for decorative purposes such as the covering of mansards, and not for area coverage, e.g., roofing systems in general. Such panels, however, have the advantage of low cost, high environmental resistance (which may be provided either by the panel material itself or by suitable, easily applied coating such as paints and plastic films), and are highly resistant to damage by impact by foreign objects, environmental extremes, etc.

Fiberglass panels with various decorative characteristics have been used to simulate tile, brick and stone, with representative panels being shown in U.S. Pat. Nos. 3,217,453 and 3,621,625. Such panels are molded from fiberglass using a press process to provide panels having a generally rectangular shape, with an interlocking tongue and groove arrangement at the four edges thereof. Panels fabricated in accordance with these two patents are generally high quality panels, and are both aesthetically pleasing and functional. However, because of the molding process and the materials from which they are fabricated, they are particularly expensive, and because of both tooling and production costs, are at a competitive disadvantage to panels fabricated from lower cost materials and/or using lower cost production techniques.

Metal roofing and siding panels are generally fabricated from materials such as aluminum. One metal siding is shown in U.S. Pat. No. 2,782,888. The element of this siding system utilizes a hook-like bend at the top of each panel to receive the lower edge of the next higher panel in the siding assembly. However, the vertical seal between sidewise adjacent panels must generally be provided by a caulking compound. Other siding and/or roofing systems utilize an outward formed hook-like region along the top of each panel, with a mating inward formed hook-like region adjacent the bottom of each panel. In this manner the lower edge of each next higher course may be hooked over the upper hook on the lower course to provide a mechanical and moisture-proof interlock therebetween. Metal roofing and siding panels have certain advantages, though are limited in the environmental integrity of the vertical and horizontal interlocking devices, are highly limited in the decorative patterns which may be created thereby and are easily damaged by foreign objects because of the softness and lack of resilience of the parent material in thin-formed sheet form, and generally provide undesirable accoustic effects in rain and hail.

Other panel-like elements are shown in U.S. Pat. Nos. 1,190,081; 2,039,536; and 2,067,059, and in Canadian Pat. No. 486,348. The elements of these patents use some form of mating or interlocking on at least two opposite sides thereof, though in general are either highly limited in the decorative pattern which may be achieved thereby and/or are expensive because of the complicated production techniques which may include the required use of composite assemblies.

BRIEF SUMMARY OF THE INVENTION

Interlocking panels having a decorative pattern thereon and having a system of interlocks for providing a weather-proof covering system for use as roofing, siding and the like. The panels may be of a readily formed material such as a thermoplastic having a decorative pattern thereon complimentary to the pattern on adjacent panels to provide a continuous decorative roofing or siding panel system. The panels have a simple hook-like region adjacent the upper edge thereof, just below the nail line retaining the panel to the roof, to receive and retain the lower edge of the panels of the next higher course in a manner so as to eliminate the otherwise exposed nailheads. Decorative patterns simulating conventional materials such as shake may be impressed into the panels by vacuum forming and/or other construction techniques. Use of a staggered panel side provides for a substantially hidden junction between sidewise adjacent panels to provide a continuous and unbroken pattern. By dropping the regions separating individual simulated shake to the basic roof plane, maximum panel stability and registry onto the roof surface, as well as enhanced visual characteristics, are achieved.

BRIEF DESCRIPTION OF THE DRAWINGS

FIG. 9 is an expanded cross section showing the mating region of two second embodiment panels also showing the horizontal plane of the cutaway view of FIG. 10.

FIG. 10 is a cutaway view showing in further detail how the left lower flange of a second embodiment panel hooks onto the trimmed lower right corner of another such panel.

DETAILED DESCRIPTION OF THE INVENTION

Figures 1, 2A, 5A:
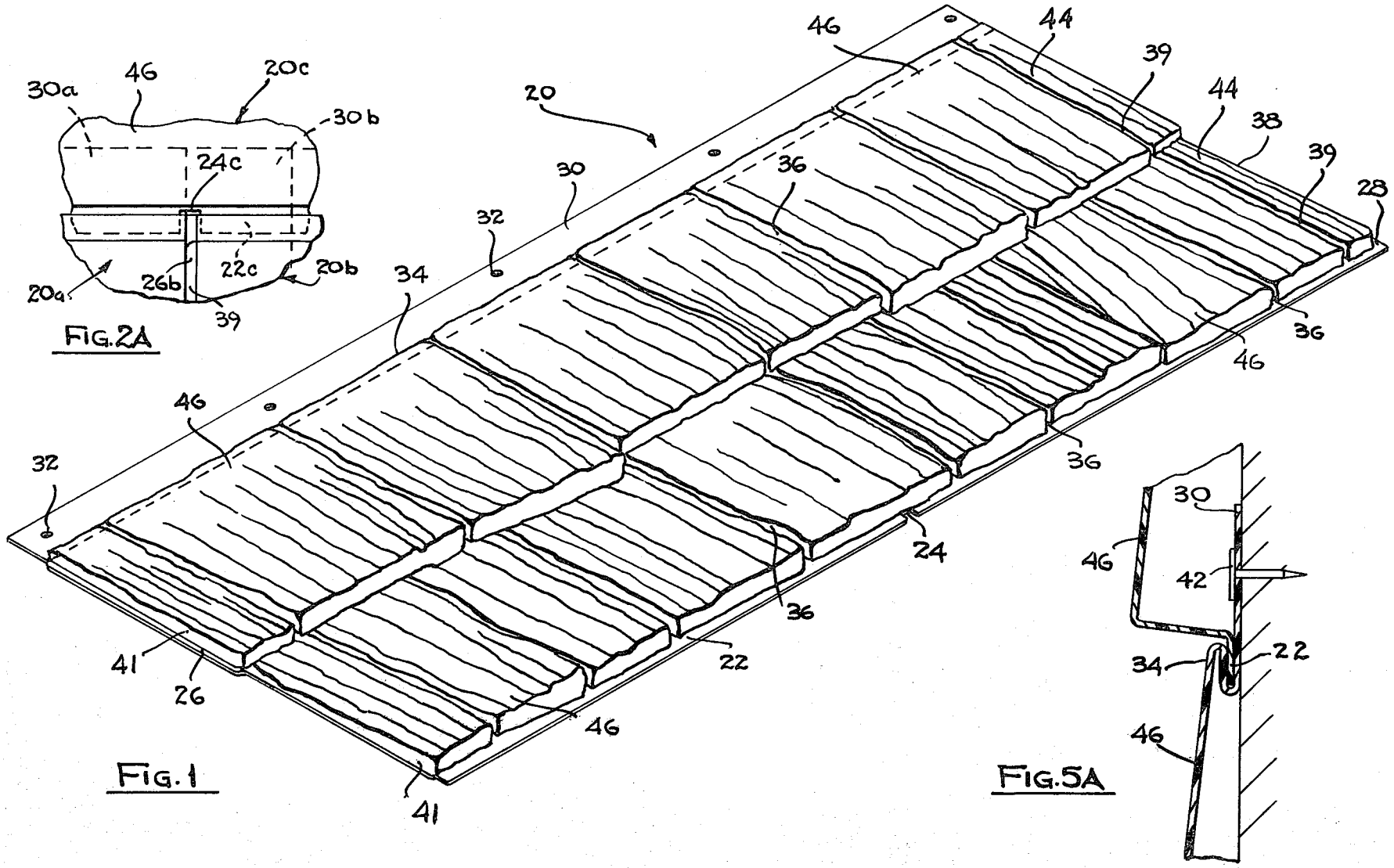
FIG. 1 is a perspective view of the preferred first embodiment panel of the present invention.
FIG. 2*a* is a plan view, taken on an expanded scale, of the region surrounding the junction of the three first embodiment panels of FIG. 2, illustrating the effect of the notch 24 in the lowr edge of the first embodiment panels of the present invention.
FIG. 5*a* is a local section of FIG. 5 taken on an expanded scale showing the mating region of the two vertically adjacent first embodiment panels.

First referring to FIG. 1, a perspective view of a first embodiment of the interlocking panel of the present invention may be seen. This panel provides a simulation of a second of wood shake such as are commonly used on roofing, and includes various provisions for fastening to a roof or building side, and for interlocking with adjacent panels to provide a weather-seal and an uninterrupted decorative pattern across the entire area covered, all without requiring exposed nails. The individual panels generally, indicated by the numeral 20, are characterized by a main central decorative area bounded at the lower edge by a flange 22 having a slight notch 24 at the center thereof, side flanges 26 and 28, and a top flange 30. As shall subsequently be seen, the side flange 28 and top flange 30 are intended for use as nailing flanges, and accordingly may be perforated during production as appropriate to provide the desired spacing of nail holes 32.

As will be explained in greater detail herein, together with the description of the function of the following features of the panel of FIG. 1, there is provided a simple S-shape fold in region 34 adjacent the upper edge of the panel to provide a continuous lip across the width of the panel for receipt of the lower flange 22 of the next higher course in a typical siding or roofing installation. Also, the right shake separation 39 of the decorative pattern 36 and the left edge 41 of the left shakes of each panel are staggered along the width of the panel in a complimentary manner so as to interfit with the respective opposite edges of the next adjacent panels in a typical installation, to provide an interfitting moisture barrier therebetween. The staggering of the sides in accordance with the random characteristics of the simulated shake, and particularly the two courses thereof, breaks up what otherwise would be a rather geometric edge pattern which would provide an undesired matrix or array appearance in a particular installation, contrary to the desired continuous and random appearance.

Also, as shall subsequently be seen in greater detail, the regions 36 between simulated shake on the panel 20 are dropped to the base plane (roof or side surface) substantially over their entire length. This is another important aspect of the present invention and provides both aesthetic and functional advantages over prior art panels. In particular, aesthetically it accurately duplicates real shake, as the gaps between wood shake do drop to the base plane (or at least to the trailing edge of the next lower course of shake). The dropping of these spaces to the base plane provides maximum shadow effect, giving maximum life and character to the simulation and making the continuous panel character substantially invisible in comparison to the plurality of individual unique simulated shake. In that regard it will be noted that the first and second preferred embodiments are formed from thermoplastic sheet material of uniform thickness by vacuum forming techniques so that various wood grains, textures, etc. may be very accurately reproduced on the finished panels, allowing the accurate simulation of random split shake, essentially not possible with metal panels and possible with fiberglass panels only with highly expensive tooling. It will be noted that the width, thickness, and to some extent the apparent grain orientation of the simulated shakes in the panel of FIG. 1 are relatively random and variable, and that the simulated thickness in general is substantial, providing an accurate simulation of the most expensive wood shake. In addition it will be noted that the apparent length of the various simulated shake elements itself is random and variable. This has advantages particularly with respect to the region coupling different courses (two courses in the panel shown in FIG. 1) of individual panels, in that it not only adds to the aesthetic character of the simulation, but any local flat region (e.g., a region of two dimensional rather than three dimensional character) is broken up so as to substantially rigidify the panel in the region of shallowest depressions 36.

Figures 6, 7, 8:
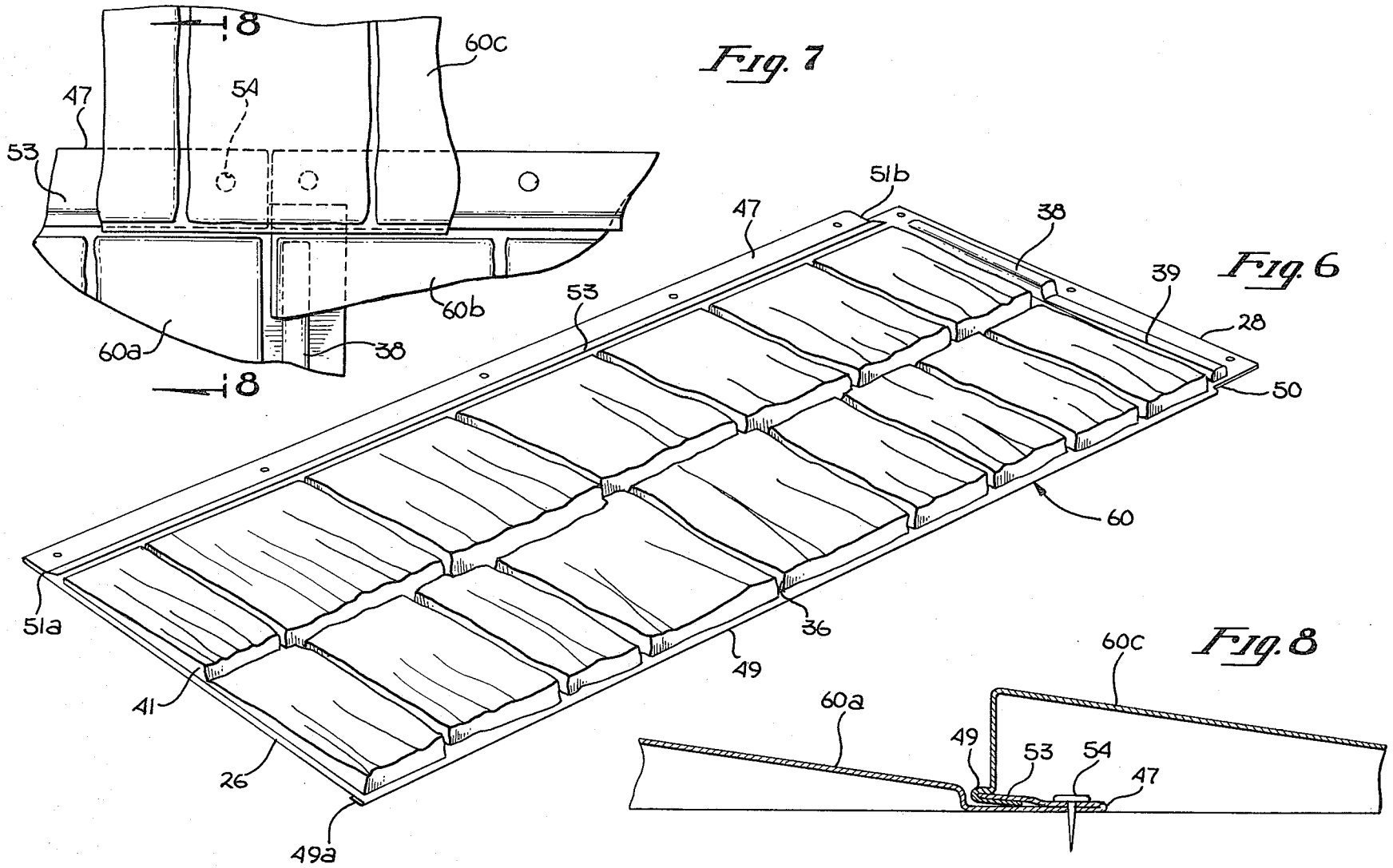
FIG. 6 is a perspective view of the preferred second embodiment panel of the present invention.
FIG. 7 is a plan view, taken on an expanded scale, of the region surrounding the junction of three second embodiment panels illustrated in 6, illustrating the interlocking at the vertical and horizontal mating regions.
FIG. 8 is an expanded cross section taken along a vertical plane illustrating the horizontal mating region of second embodiment panels.

In FIG. 1 and FIG. 6 the extent of the character of the wood shake simulation and the random variation in thickness, width, etc. of the various shake is suggested therein. However, in the remaining FIGURES, the decorative portion of the panel of the present invention is shown schematically only, with the individual simulated shake having a more geometric character, as the purpose of these additional figures is to illustrate the edge structure and interfit rather than the decorative character.

Figure 2:
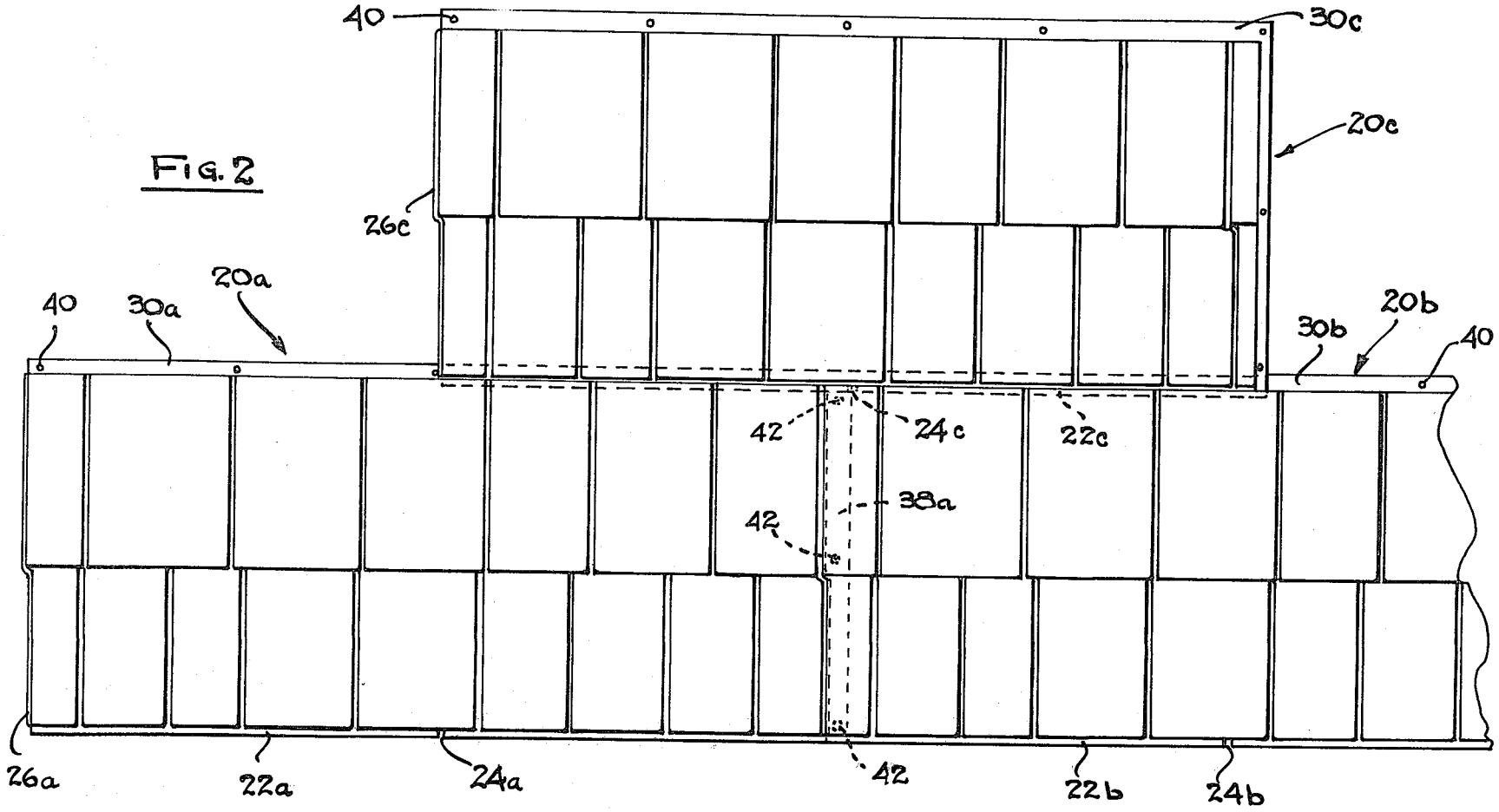
FIG. 2 is a schematic illustration of the assembly of three first embodiment panels representative of their intercooperation to provide a system for the coverage of large areas.

Now referring to FIG. 2, a portion of a wall covering illustrating the mating of three first embodiment panels of the present invention, specifically, panels 20*a*, 20*b* and 20*c*, may be seen. Panel 20*a* is first fastened to the wall or roof to be covered by nails 40 along the top edge 30*a* thereof and nails 42 along the right edge 38*a* thereof. For the lowermost course, nails may also be applied to the lower lip or flange 22*a* and for the lower left panel along the flange at the left side of the panel (installation proceeds from left to right, proceeding with the other courses first). The second panel 20*b* is then placed in position so that the left edge thereof overlaps the right edge of panel 20*a* as shown, with the panel 20*b* also being nailed into position.

Figure 3:
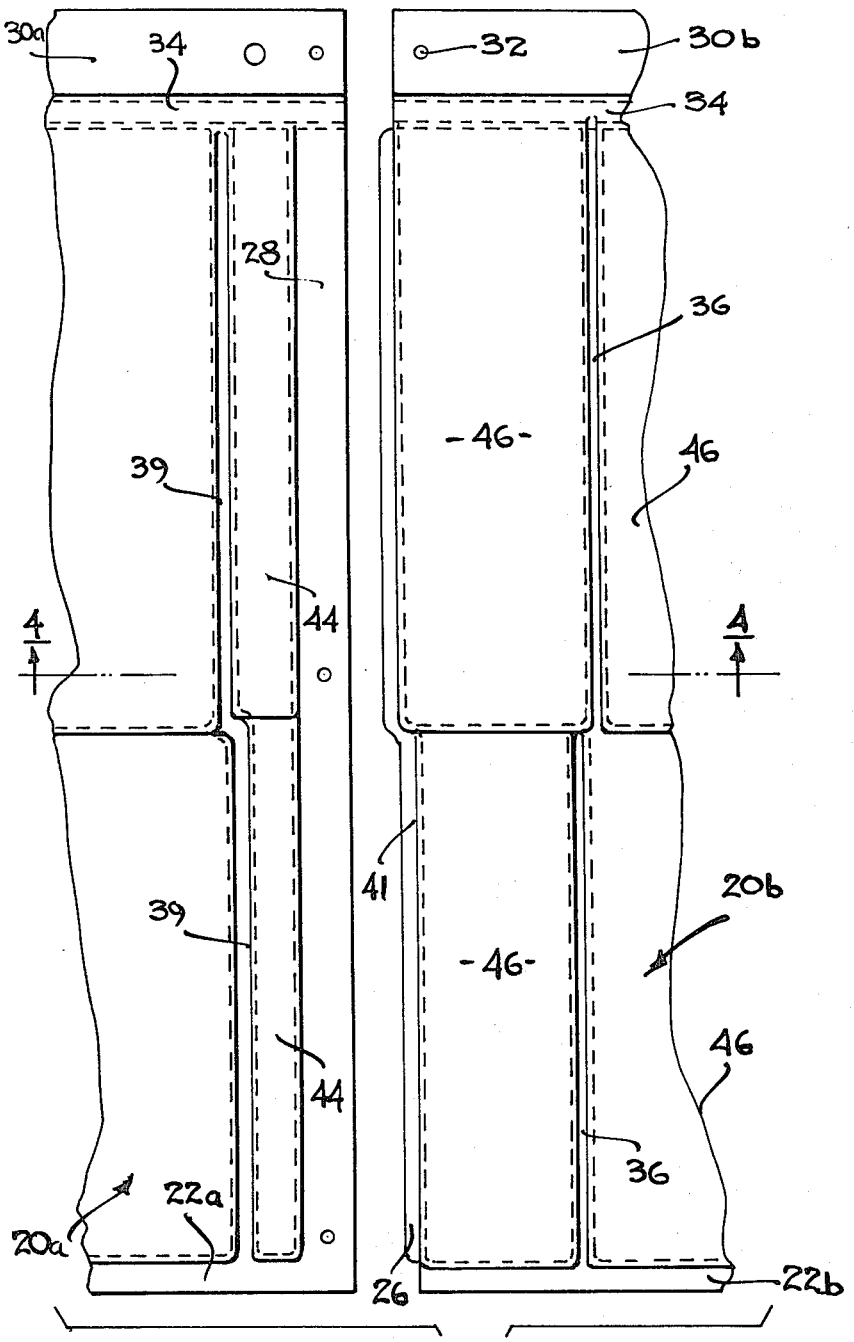
FIG. 3 is an exploded view of the mating region of two first embodiment panels also illustrative of the lateral side mating of second embodiment panels.
Figure 4:
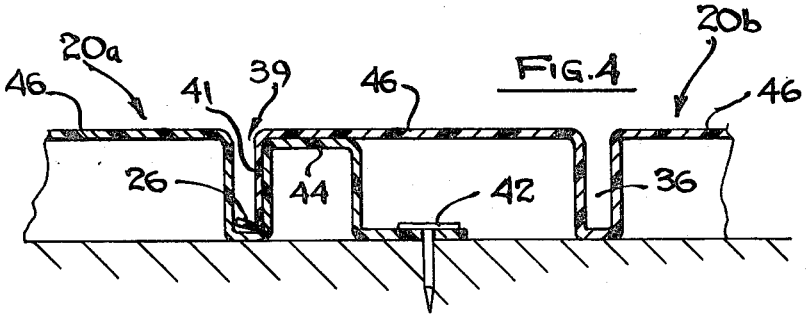
FIG. 4 is a cross section illustrating the vertically disposed mating region of two first embodiment panels.

The horizontal mating of two panels such as panels 20*a* and 20*b* is best illustrated in FIG. 3 showing the planform character of the mating regions of two adjacent panels, and FIG. 4 showing the cross section of two mating panels taken along line 4—4 of FIG. 3. It will be noted in these FIGURES) that the depression 36 adjacent the right edge of each panel is randomly staggered and for that matter may be contoured as desired to simulate the characteristic random course to course location of conventional shakes. It will be noted also that the partial shakes 44 at the right hand edge of each panel are slightly lower in height than the shakes 46 at the right hand edge of the panels, so that the panels will appropriately interfit as shown in FIG. 4. In addition, the flanges region 26 is trimmed in manufacture (together with the thickness of the material) so as to be slightly wider than the gap 36 in the separation between simulated shake at the right hand side of the panel. This allows the left hand edge of the next panel (20*b* in the illustration of FIG. 4) to be pressed into the gap 36 to provide a wedging or self-locking tendency therein. In this manner the moisture barrier and a locking of sidewise adjacent panels is achieved without creating a visible vertical line or pattern of vertical lines to detract in any way from the appearance of a roof or building side. If desired, depending upon the particular installation, a caulking compound or plastic cement may be used in this joint, as the joint is rather well hidden by the manner in which it is created, though use of caulking compounds and/or cement is optional.

Figure 5:
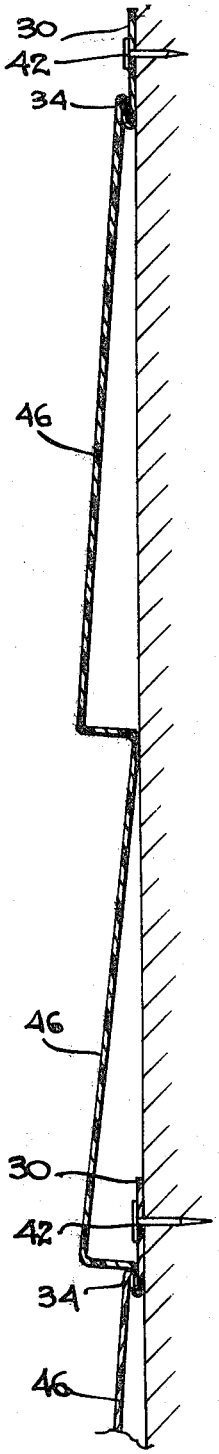
FIG. 5 is a cross section of two mating first embodiment panels taken along a vertical plane illustrating the mating of adjacent panels along the horizontal mating region.

Now referring to FIGS. 5 and 5*a*, a cross section between two vertically adjacent first embodiment panels in an assembly and an expanded cross section of the mating region between such panels may be seen. It will be noted that each panel, as hereinbefore described, has a simple S-shaped bend in region 34 to provide an upward directed horizontal channel to receive the lower flange 22 of the panel in the next higher course of panels in an assembly. Thus by nailing the top edge (and right hand edge or flange if desired), each course of panels is secured at the top thereof by nails and at the bottom thereof by interfitting in the channel defined by the next lower course of panels. Of course, if desired, a cement or caulking compound may be used in this channel also, though in general such use is not required. Because of the nature of the interfit between vertical courses, the advantage of the relative stiffness of each panel hereinbefore described is readily apparent.

Referring again to FIG. 2, it will be noted that in the preferred first embodiment the panels in any one course are preferably staggered with respect to the panels in the immediately lower and immediately higher course of panels. Further, while the edges of the decorative pattern interfit (cooperatively overlap) as shown in FIG. 4, the folded regions 34 and the upper flanges 30 overlap by approximately one-half to one inch. Thus, with respect to a staggered panel in the next course, the upward facing slot to receive the lower edge of that panel is a discontinuous slot, having approximately one-half defined by the slot in the left lower panel, and the other approximately one-half defined by the channel in the right lower panel. This discontinuity however, is readily compensated for by the slight slot or cut-out 24 on the lower flange 22 of each panel, effectively partially dividing the lower flange into a left portion or tab for fitting into the upward directed slot of the left lower panel in an assembly, and a right lower portion or tab for fitting into the upward directed slot of the left upper portion of the right lower panel. Thus vertical registry as well as sidewise registry of each panel in each successive course is automatically defined, allowing the rapid and accurate installation of the panels in the present invention for a high pleasing, environmentally resistant panel system. In the region of overlap of two adjacent panels in the vicinity of the slots 34 along the upper edge thereof the slot may be pressed flat to avoid undue thickness buildup from the overlap, as the open slot in this region is not functionally required.

Finishing of an installation such as a roof may readily be accomplished in accordance with well-known techniques utilizing finishing elements having compatible decorative characteristics. By way of example a simple vacuum-formed ridge cover simulating a shake ridge may readily be fabricated and installed in the same manner as prior art ridge covers of aluminum and fiberglass. Similarly roof edges, valleys, etc. may also be finished utilizing members of the same type as are known in the prior art for other roofing panel systems. In that regard it should be noted that all such finishing elements need not be vacuum-formed, as metal or components of other materials may also be used if finished in the same or complimentary colors. Further, in the preferred first and second embodiments, complete half panels (e.g., panels having finished edges though only one-half the width of the panels shown in the drawings herein) are also manufactured so as to even the vertical starting edge irrespective of the staggered courses of panels.

Now referring to FIG. 6, a perspective view of a second embodiment of interlocking panels of the present invention, indicated generally by the numberal 60, may be seen. The main central decorative area and side flanges 26 and 28, the interconnecting right shake separation 39 and the left edge 41 of the left shakes, and regions 36 of the second embodiment panel 60 are identical to those of the first embodiment hereinbefore described. In the embodiment of FIG. 6 however, as will be explained in greater detail herein, there is provided in the upper edge of the panel 60 an outward medially extended fold 47 to offer a downward extending continuous lip across the width of the central raised portion of shakes for the receipt of the lower flange 49 of the next higher course in a typical installation. Perforations may be made during production through the lateral nailing flange and both sides of the upper fold 47.

Referring to FIGS. 6 through 10, the second embodiment panels interfit in a manner very similar to the panels of the first embodiment. A panel 60*a* corresponding to 20*a* is first fastened to the wall or roof as before. However, as shown in the expanded cross section FIG. 9 and cutaway view in FIG. 10, the second embodiment panel 60*b* corresponding to 20*b* is placed in position so that the left lower flange 49*a* hooks onto the trimmed lower right corner 50 of the panel 60*a* corresponding to 20*a*, and is then placed and pressed down so that the left edge 41 thereof overlaps the right edge 38 of the panel 60*a* corresponding to 20*a*. The second panel is then nailed into position. The upper left corner 51*a* of the second panel 60*b* overlaps the trimmed fold 51*b* at the upper right corner of the first panel 60*a* as shown in FIG. 7 in an expanded plan view. It is important to note that this embodiment results in continuous hook like regions on each course of panels, negating the need for any notch such as notch 24 of the first embodiment (see FIG. 1).

Referring too FIG. 8, an expanded cross section of the mating region between two vertically adjacent second embodiment panels 60*a* and 60*c* in an assembly can be seen. As described earlier, the upper edge of the lower course panel 60*a* is folded outward and medially, so that when such fold is nailed to the covered surface the fold becomes flatened and the lower edge of the fold extends outward to form a continuous lip 53 upon which the next higher course panel 60*c* may be hooked. The interfit between the short curved lip 49 of the lower edge of the upper course panel and the short angled lip of the fold of the lower course panel is rigidified and strengthened by the pressing of the corner of the angle toward the base plane when the nail is affixed, in a manner analogous to the strengthening of the entire panel by extension of the sections between individual shakes to the base plane.

Referring to FIGS. 2 and 7, it will be noted that in the preferred second embodiment the panels in any one course may be further staggered without limitation with respect to the panels in the immediately lower and higher course. The interfit shown in FIG. 4 causes no discontinuous overlap in the second embodiment, as the upper and lower right corners of the folds have been trimmed to prevent discontinuous overlap. Extension of the panel course beyond the surface covered may be trimmed and finished, with the trimmed panel available for use to begin the next course of panels.

There has been described herein a new and unique panel system for providing an accurate and high quality simulation of wood shake roofs in a continuous manner unbroken by aesthetically detracting joints, caulked regions, etc. The present invention is ideally suited to fabrication from thermoplastic sheets by vacuum-forming techniques, as the only specially formed edges may comprise simple folds formed at the time of vacuum-forming or subsequent thereto. While the invention is also particularly well suited to the fabricated of panels simulating shake because of its ability to provide high character and accuracy in such simulation, and the fact that conventional shake and thus the simulation thereof tapers to a minimum thickness adjacent the upper portion of each course, the present invention interlocking panels may be applied to the simulation of other roofing and siding materials such as by way of example, various forms of tile.

As a further alternative to the present invention, and particularly as an alternate embodiment of the simulated shake of the embodiment disclosed herein, panels of proportions other than that suggested by FIG. 1 or FIG. 6 may be utilized. By way of specific example it will be noted that the embodiments of FIG. 1 and the subsequent FIGURES provides the simulation of two courses of shake on a single panel, providing a convenient sized rectangular panel having a width on the order of twice the height thereof. Obviously panels containing a single course or more than two courses may readily be fabricated. Of special interest, however, are substantially rectangular panels (neglecting the staggered edges thereof) which are oriented with the longer dimension running in a vertical dimension (e.g., running up and down a roof or building side) rather than in the horizontal direction as in the embodiment of FIG. 1. In particular, panels a few feet wide may be fabricated so that single panels may extend from the base of the roof to the ridge thereof eliminating the need for any horizontal coupling and seal, other than a simple ridge cover. Since certain roofing applications, such as mobile homes, generally have standard sizes, installation could be accomplished without cutting or trimming of standard panels. Such a panel would be easily and quickly installed, and would provide a highly reliable and decorative finish to the roofs (or sides) of mobile homes. Obviously other changes and variations in the proportions, decorative character, etc. of the panels of the present invention may readily be made. Thus while the present invention has been disclosed and described with respect to certain specific preferred embodiments thereof, it will be understood by those skilled in the art that various changes in form and detail may be made therein with departing from the spirit and scope of the invention.

I claim:

1. A panel for use in plurality to simulate wood shake covering an area, comprising a panel member formed from a unitary sheet of thermoplastic having upper, lower and first and second side edges, and having an area therebetween with the desired three dimensional decorative pattern on the top surface thereof simulating a plurality of individual wood shake, said decorative pattern including a hollow raised portion at least adjacent said first side edge thereof, said unitary sheet having a first planar region above said three-dimensional decorative pattern for lying flat against a surface to be covered, and a second region extended between said first planar region and said upper edge of said unitary sheets, said second region being folded through approximately 180° to overlie said first planar region to define a slot adjacent and facing the top of said decorative pattern with a double thickness nailing flange thereabove, said double thickness nailing flange being defined by a portion of said second region immediately overlying and substantially in face to face abutment with a portion of said first planar region, the remainder of said second region being formed to only overlie the first planar region with a space therebetween which is substantially unaffected by the passing of nails through said nailing flange during installation of the panels, said bottom edge of said unitary sheet being curved under to define a lip adjacent and under the lower region of said panel approximately parallel to said first planar region, said slot being proportioned to receive and retain at least a portion of the lip of a similar decorative panel, said panel member further having a raised portion adjacent said second side edge thereof, complimentary to said hollow raised portion adjacent said first side edge, whereby said first side edge of one panel may overlie the second side edge of another panel to provide a decorative pattern extending across both panels with a moisture barrier therebetween, at least one end of said slot in each panel terminating short of the adjacent edge of said panel so that the slots in adjacent panels cooperate to provide a slot of substantially uniform elevation across adjacent panels, and at least one end of said lip also terminating short of the adjacent edge of said panel so that the lips in adjacent panels are substantially colinear to mate with the slots defined by similar panels in a lower course in any desired staggered relationship.

2. The panel of claim 1 wherein said panel member has a thickness which is substantially less than the thickness of the simulated shake, and wherein a substantial part of said panel member in the regions between individual said simulated shake is disposed approximately in the plane defined by the flange-like extensions adjacent the top and bottom edges of said panel member, thereby defining separations between individual adjacent simulated shake.

3. The panel of claim 2 further comprised of a first side flange like protrusion extending between said first side edge and said hollow raised portion adjacent said first side edge of said panel member.

4. The panel of claim 3 wherein said first side flange-like protrusion has an extend at least as wide as the corresponding separation between individual simulated shake adjacent said second side edge of said panel, whereby said first side flange-like protrusion of one panel may be wedged into said separation between individual simulated shake adjacent said second side edge of another of said decorative panels.

5. The panel of claim 1 wherein said decorative panel simulates wood shake in a plurality of courses, and wherein the individual simulated shake are of varying length, whereby the junction between shake in different courses varies in relative position between said upper and lower edges of said decorative panel.

6. The panel of claim 1 wherein said decorative pattern simulates shake in a plurality of courses, and wherein said simulated wood shake adjacent said first side edge are staggered.

7. A decorative panel for use in plurality to simulate wood shake covering an area comprising a unitary sheet of thermoplastic, said sheet having upper, lower and first and second side edges, and having a substantial decorative portion therebetween formed away from a base plane to simulate a plurality of individual shake arranged in a plurality of courses and defining a hollow raised portion adjacent said first side edge of said sheet, said sheet being folded upward through approximately one hundred eighty degrees to provide a slot adjacent the top of and facing said decorative portion with a double thickness flange-like extension in said base plane extending between said slot and the upper edge of the panel, said double thickness nailing flange being defined by a portion of said sheet immediately overlying and substantially in face to face abutment with another portion of said sheet, the portion of said sheet defining said slot being formed to only overlie the adjacent region of the sheet with a space therebetween which is substantially uneffected by the passing of nails through said nailing flange during installation of the panels, the lower portion of said sheet being folded under to form a lip under the lower part of the decorative portion and approximately parallel to said flange like extension, said slot being proportioned to receive and retain at least a portion of the lip of a similar decorative panel, the edges of said simulated shake in at least two courses adjacent said first side edge of said sheet being staggered, said sheet further having a raised portion adjacent said second side edge thereof complimentary to said hollow raised portion adjacent said first side edge, whereby said first side edge of one panel may overlie the second side edge of another panel to provide a decorative pattern extending across both panels with a moisture barrier therebetween, and a flange-like region extending between said hollow raised portion adjacent said second side edge and said second side edge, at least one end of said slot in each panel terminating short of the adjacent edge of said panel so that the slots in adjacent panels cooperate to provide substantially colinear slots across adjacent panels, and at least one end of said lip also terminating short of the adjacent edge of said panel so that the lips in adjacent panels are substantially colinear to mate with the slots defined by similar panels in a lower course in any desired staggered relationship.

8. The panel of claim 7 wherein said simulated shake have varying lengths, whereby the junction between adjacent courses on said panel is staggered.

9. The panel of claim 7 further comprised of a first side flange-like protrusion extending between said first side edge and the individual simulated shake adjacent said first side edge of said panel member.

10. The panel of claim 9 wherein said first side flange-like protrusion has an extent at least as wide as the corresponding separation between individual simulated shake adjacent said second side edge of said sheet, whereby said first side flange-like protrusion of one panel may be wedged into said separation between individual simulated shake adjacent said second side edge of another of said decorative panels.

* * * * *